US008854220B1

(12) United States Patent
Smith et al.

(10) Patent No.: US 8,854,220 B1
(45) Date of Patent: Oct. 7, 2014

(54) INDICATING DESICCANT IN NIGHT VISION GOGGLES

(75) Inventors: William Allen Smith, Daleville, VA (US); Scott Joseph Adams, Roanoke, VA (US); Jean Cathcart, Daleville, VA (US)

(73) Assignee: Exelis, Inc., McLean, VA (US)

( * ) Notice: Subject to any disclaimer, the term of this patent is extended or adjusted under 35 U.S.C. 154(b) by 1059 days.

(21) Appl. No.: 12/871,142

(22) Filed: Aug. 30, 2010

(51) Int. Cl.
*G08B 21/00* (2006.01)
*G08B 21/20* (2006.01)
*H01J 31/50* (2006.01)

(52) U.S. Cl.
CPC ..... *H01J 31/50* (2013.01); *G08B 21/20* (2013.01)
USPC ..... 340/604; 73/76; 257/682

(58) Field of Classification Search
CPC ..... H01L 27/1214; G09G 3/3233; G09G 3/3648; G09G 2320/0252; G02B 23/125
USPC ..... 250/214 VT; 340/601–604; 116/200; 257/682; 73/73–77; 324/634, 640, 643, 324/664–670, 689, 694–696; 200/61.04–61.07; 338/35
See application file for complete search history.

(56) References Cited

U.S. PATENT DOCUMENTS 4,000,419 A * 12/1976 Crost et al. ..... 250/214 VT
4,463,252 A * 7/1984 Brennan et al. ..... 250/214 VT
4,653,879 A * 3/1987 Filipovich ..... 250/330
4,658,139 A * 4/1987 Brennan et al. ..... 250/330
4,755,664 A * 7/1988 Holmes et al. ..... 250/214 VT
4,999,034 A 3/1991 Mager et al.
5,254,852 A * 10/1993 Filipovich et al. ..... 250/214 VT
5,272,514 A * 12/1993 Dor ..... 356/251
5,517,700 A 5/1996 Hoffman
5,839,284 A * 11/1998 Wyatt et al. ..... 62/3.2
6,913,668 B2 7/2005 Matzinger
6,956,268 B2 * 10/2005 Faris ..... 257/415
7,173,237 B2 2/2007 Palmer et al.
7,403,281 B2 * 7/2008 Carron et al. ..... 356/301
7,566,177 B2 * 7/2009 Thompson ..... 396/427
2002/0114069 A1 * 8/2002 Plotsker ..... 359/407
2004/0021938 A1 * 2/2004 Filipovich et al. ..... 359/409
2004/0094700 A1 * 5/2004 Filipovich et al. ..... 250/251
2005/0088079 A1 * 4/2005 Daniels ..... 313/504
2006/0291849 A1 * 12/2006 Shamir et al. ..... 396/334
2007/0014916 A1 * 1/2007 Daniels ..... 427/66
2007/0279238 A1 * 12/2007 Smith et al. ..... 340/686.6
2008/0068359 A1 * 3/2008 Yoshida et al. ..... 345/204
2008/0079001 A1 * 4/2008 Umezaki et al. ..... 257/59
2008/0079685 A1 * 4/2008 Umezaki et al. ..... 345/100
2008/0136990 A1 * 6/2008 Kimura ..... 349/46
2008/0204361 A1 * 8/2008 Scales et al. ..... 345/8

(Continued)

*Primary Examiner* — Hai Phan
*Assistant Examiner* — Orlando Bousono
(74) *Attorney, Agent, or Firm* — RatnerPrestia

(57) ABSTRACT

A night vision goggle system includes a housing, and an eyepiece forming a back end of the housing for viewing an object of interest. An optical field-of-view (FOV) is formed through the eyepiece, where the FOV is defined by a cone having an apex formed adjacent to an exit pupil at the eyepiece and tapering outwardly toward the object of interest. A desiccant is disposed within the housing, and located outside the FOV. The desiccant is visible through the eyepiece when viewed from outside the FOV. In addition, when the eye of a user is placed within the FOV, the desiccant is not visible through the eyepiece; and when the eye of the user is placed outside the FOV, the desiccant is visible through the eyepiece.

17 Claims, 3 Drawing Sheets

(56) References Cited

U.S. PATENT DOCUMENTS

2008/0248191 A1* 10/2008 Daniels ..... 427/66
2008/0266669 A1* 10/2008 Durner et al. ..... 359/630
2008/0284710 A1* 11/2008 Kimura et al. ..... 345/98
2008/0284719 A1* 11/2008 Yoshida ..... 345/102
2008/0284768 A1* 11/2008 Yoshida et al. ..... 345/208
2008/0284929 A1* 11/2008 Kimura ..... 349/38
2008/0284934 A1* 11/2008 Umezaki et al. ..... 349/43
2009/0001469 A1* 1/2009 Yoshida et al. ..... 257/347
2009/0002590 A1* 1/2009 Kimura ..... 349/43
2009/0009455 A1* 1/2009 Kimura ..... 345/89
2009/0102752 A1* 4/2009 Honda ..... 345/55
2009/0224245 A1* 9/2009 Umezaki ..... 257/59
2009/0225010 A1* 9/2009 Kimura ..... 345/76
2009/0289968 A1* 11/2009 Yoshida ..... 345/691
2009/0303219 A1* 12/2009 Kimura et al. ..... 345/211
2010/0103089 A1* 4/2010 Yoshida et al. ..... 345/102
2010/0128135 A1* 5/2010 Filipovich et al. ..... 348/217.1
2010/0133533 A1* 6/2010 Umezaki ..... 257/43
2010/0134396 A1* 6/2010 Umezaki ..... 345/92
2010/0141630 A1* 6/2010 Kimura ..... 345/211
2010/0156955 A1* 6/2010 Kimura ..... 345/690
2010/0182226 A1* 7/2010 Umezaki ..... 345/98
2010/0182306 A1* 7/2010 Kimura et al. ..... 345/213
2010/0193785 A1* 8/2010 Kimura ..... 257/43
2010/0201719 A1* 8/2010 Kimura ..... 345/690
2010/0220092 A1* 9/2010 Kimura ..... 345/213
2010/0220117 A1* 9/2010 Kimura ..... 345/690
2010/0245304 A1* 9/2010 Umezaki ..... 345/205
2010/0245307 A1* 9/2010 Kimura et al. ..... 345/206
2010/0245335 A1* 9/2010 Kimura et al. ..... 345/213
2010/0246750 A1* 9/2010 Kimura et al. ..... 377/64
2010/0295838 A1* 11/2010 Umezaki et al. ..... 345/211
2011/0018915 A1* 1/2011 Umezaki et al. ..... 345/698
2012/0002064 A9* 1/2012 Filipovich et al. ..... 348/217.1

* cited by examiner

INDICATING DESICCANT IN NIGHT VISION GOGGLES

FIELD OF INVENTION

The present invention relates to a night vision system equipped with an indicating desiccant for absorbing moisture within the system. When the desiccant is saturated with moisture, a user of the night vision system is alerted that the system requires maintenance.

BACKGROUND OF THE INVENTION

Conventional night vision devices are purged and nitrogen filled to protect optics and electronics over a range of temperatures. Temperature extremes cause condensation to occur within the devices which, in turn, cause the night vision devices to degrade or fail. There typically is no indication to the user of loss of nitrogen within the device, other than a system failure. These devices are, therefore, serviced on a regular basis in order to remove moisture from the device and purge the system with nitrogen.

There are systems, however, that include desiccants within their housing to help capture moisture from the environment. Desiccants are used in many electronics and food storage applications to help reduce and control moisture, or humidity within the housing. These desiccants provide a longer lifetime for the system, but once saturated with moisture, the system may still degrade or fail.

Indicating desiccants are used in some devices in order to alert the user of the device that the desiccant is saturated and no longer effective in removing moisture from the housing. These indicating desiccants typically change color to alert the user that the desiccant is no longer effective. The system is then typically serviced to remove the desiccant and a fresh desiccant is inserted in the housing.

SUMMARY OF THE INVENTION

To meet this and other needs, and in view of its purposes, the present invention provides a night vision goggle system including a housing; an eyepiece forming a front end of the housing for viewing an object of interest; and an optical field-of-view (FOV), formed through the eyepiece, where the FOV is defined by a cone having an apex formed adjacent to the eyepiece at the pupil and tapering outwardly toward the object of interest. A desiccant is disposed within the housing, and located outside the FOV. The desiccant is visible through the eyepiece, and not visible through the FOV.

When the eye of a user is placed within the FOV, the desiccant is not visible through the eyepiece; when the eye of the user is placed outside the FOV, however, the desiccant is visible through the eyepiece.

The FOV passes through an optical assembly extending between the eyepiece and an image intensifier, and the desiccant is visible through the same optical assembly.

A plurality of desiccants may be disposed within the housing, and located outside a peripheral boundary of the FOV. The plurality of desiccants may be visible through the eyepiece, and not visible through the FOV.

The desiccant may include an indicator substance that noticeably changes color as the desiccant becomes saturated with moisture.

A gap may be formed in the volume of space between an interior surface of the housing and an exterior surface of an image intensifier disposed in the housing. The indicating desiccant is disposed in the gap. The FOV is free-of the indicating desiccant, the latter disposed in the gap.

Another embodiment of the present invention is a night vision goggle system. The system has a housing including an optical field-of-view (FOV) for viewing an object through an eyepiece of the goggle system, where the FOV is defined by an outward taper from adjacent the eyepiece toward the object of interest. The FOV includes a peripheral boundary. Circuitry is included in the night vision goggle system for operating the system. A humidity sensor is disposed adjacent to, or on a board of the circuitry of the night vision goggle system. An indicating light emitting diode (LED) is visible through the eyepiece. The humidity sensor is electrically coupled to the LED, where the LED is activated when the humidity sensor senses moisture adjacent or about the circuitry.

The LED is not visible when a viewer views the object in the FOV. The desiccant may be a MEMS humidity sensor.

Still another embodiment of the present invention is an optical device for viewing a subject of interest. The device includes a housing containing optics for is viewing the subject of interest, an eyepiece forming a back end of the optics, and an optical field-of-view (FOV), extending from the eyepiece, in which the FOV is defined by a cone having an apex formed adjacent to the eyepiece at the pupil and tapering outwardly toward the object of interest. A desiccant is disposed within the housing, and located outside the FOV. The desiccant is visible through the eyepiece, and not visible through the FOV.

The FOV passes through the optics extending between the eyepiece and the object of interest, and the desiccant is visible through the same optics.

The desiccant may include a MEMS humidity sensor.

It is understood that the foregoing general description and the following detailed description are exemplary, but are not restrictive, of the invention.

BRIEF DESCRIPTION OF THE DRAWINGS

The foregoing summary, as well as the following detailed description of exemplary embodiments of the invention, will be better understood when read in conjunction with the appended drawings, which are incorporated herein and constitute part of this specification. For the purposes of illustrating the invention, there are shown in the drawings exemplary embodiments of the present invention. It should be understood, however, that the invention is not limited to the precise arrangements and instrumentalities shown. In the drawings, the same reference numerals are employed for designating the same elements throughout the several figures. In the drawings.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

In general, the present invention relates to a night vision system with an indicating desiccant installed within the housing, such that it may be seen through the eyepiece or other viewing port. The desiccant allows for a real time check of the humidity level of the interior of the housing during normal operation. If the indicating desiccant changes color, the system is saturated with moisture and has likely lost purge and needs maintenance.

As will be explained, in one embodiment of the present invention, the indicating desiccant is placed so that it does not obstruct the normal view of the user through the eyepiece. During normal operation, the user views a scene through the eyepiece and does not see the indicating desiccant. In order to view the indicating desiccant, the user moves his eye so that it is outside the normal field of view of the eyepiece and only then is able to see the indicating desiccant.

Additionally, in another embodiment of the present invention, the indicating desiccant is placed on a circuit board within the housing of the device. When the indicating desiccant becomes saturated, it triggers a light emitting diode (LED) that alerts the user to a potential failure of the device.

While the present invention is described as an indicating desiccant embodied within a night vision device, it will be appreciated that the present invention may include an indicating desiccant embodied within any housing in which excess moisture may cause system failure.

Figure 1:
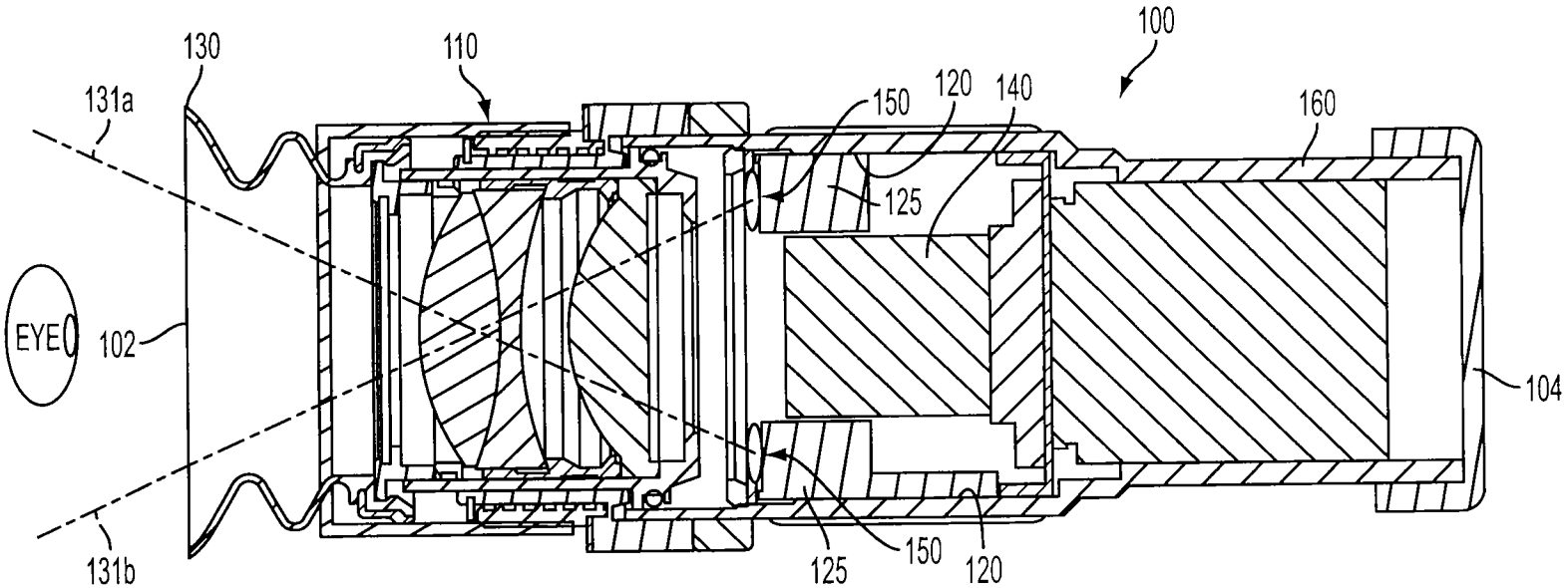
FIG. 1 is a cross-sectional illustration of an exemplary night vision system equipped with an indicating desiccant located outside of the field-of-view of the user.

Referring first to FIG. 1, there is shown a cross-sectional view of a night vision goggle system, generally designated as 100. The goggle system includes eyepiece 110, image intensifier 140 and objective lens assembly 160, which is are housed within housing 120. The back end 102 of the night vision goggle includes eyecup 130 and the front end 104 of the night vision goggle includes the objective lens assembly 160. Eyecup 130 allows the user to place his eye at the exit pupil of the eyepiece, so that the target of interest may be viewed. In a monocular optical chain the user places one eye next to the eyepiece. In a binocular optical chain, the user places both eyes next to two identical eyepieces (only one is shown).

When the user looks through eyepiece 110, the user sees an unobstructed view of the target, as light from the target is reflected into objective lens assembly 160, amplified by image intensifier 140 and transmitted to the eyepiece by way of multiple lenses in eyepiece 110. The lenses may be adjusted, as necessary, to provide a better view of the target of interest.

In one exemplary embodiment, indicating desiccant 150 is located within housing 120. The indicating desiccant 150 may be a placed at one or more locations outside of the field-of-view (FOV) of the optical path of light reflected from the target of interest. Thus, one indicating desiccant 150 may be placed at a top portion within a recessed volume 125 in housing 120, and another indicating desiccant 150 may be placed at a bottom portion within the recessed volume 125. As shown in the example of FIG. 1, the recessed volume 125 is the volume between the tubular surface of image intensifier 140, the tubular surface of housing 120 and the eyepiece. In another embodiment, only one indicating desiccant is placed in recessed volume 125. The indicating desiccant may also be shaped as a disc and may surround the tubular surface of image intensifier 140. Of importance is that the indicating desiccant be placed outside of the FOV of the optical path of light.

During normal operation, the viewer places his eye within the FOV and only sees the target of interest. However, when the viewer moves his eye to a region outside of the FOV, designated for example as 131*a* or 131*b*, the viewer sees the indicating desiccant. The indicating desiccant may be slightly out of focus, but any change in color of the desiccant may readily be seen by the viewer.

The indicating desiccant thus serves a dual purpose as it absorbs moisture that may build up in housing 120 and alerts the viewer that the device should be serviced and purged of moisture. Once indicating desiccant 150 becomes saturated, the color of the desiccant changes. For example, the indicating desiccant may turn to a darker shade of color as it becomes more and more saturated. The desiccant may be provided with an indicator substance that noticeably changes color as the desiccant becomes saturated with moisture.

As described, the indicating desiccant of the present invention is located outside the periphery of the user's normal field-of-view (FOV). The location of the desiccant does not block the normal FOV and, as such, is not a distraction to the user when viewing an image through the eyepiece of the goggle. In order to see the desiccant through the same eyepiece, however, the user moves his head slightly, so that he now has a view outside the periphery of the normal FOV.

The desiccant 150 indicates to the user that the desiccant is saturated with moisture. With this knowledge, the user may switch to a different night vision goggle system and prepare the moisture saturated night vision goggle system for repair. The latter may include removing the saturated desiccant and purging the system with nitrogen. The goggle system may also be fitted with a similar, new unsaturated indicating desiccant.

Figure 2:
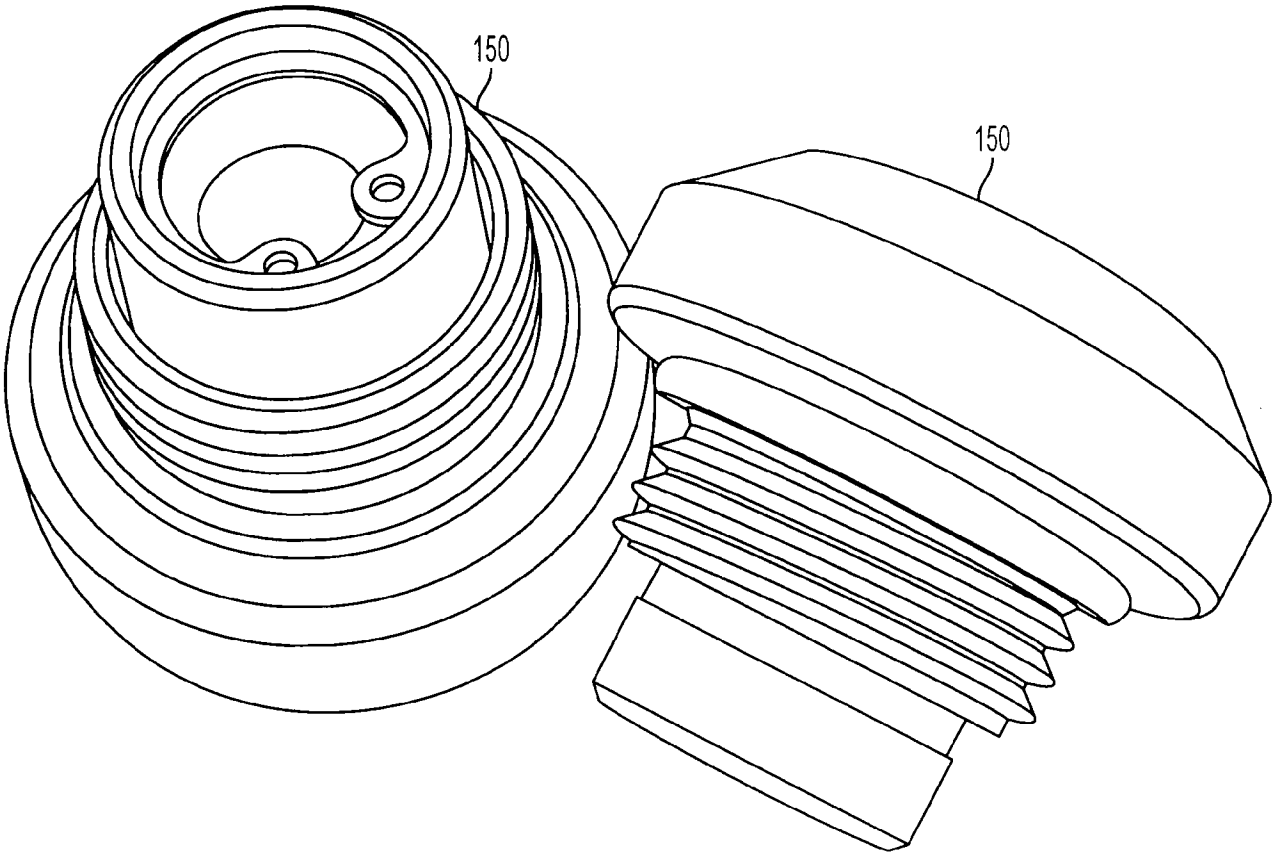
FIG. 2 is an illustration of an indicating desiccant that may be used in the present invention.

Any number of methods may be employed to secure the desiccant in the housing of the system. The methods may include securing the desiccant through a snap-tight system, threading the desiccant into place, or some other means of attachment. An exemplary desiccant, shown in FIG. 2, is housed within device 150 and includes threads for securing the desiccant to the interior of housing 120.

In an alternative embodiment of the present invention, indicating desiccant 150 may be replaced with a micro-electrical mechanical system (MEMS) humidity sensor. Such humidity sensors may be coupled to a light indicator, such as light emitting diode (LED) 250, shown in FIG. 3. The LED 250 is located outside the periphery of the user's normal field-of-view (FOV). Its location does not block the normal FOV and, as such, is not a distraction to the user when viewing an image through the eyepiece of the goggle. In order to see LED 250 through the same eyepiece, however, the user moves his head slightly, so that he now has a view outside the periphery of the normal FOV. Alternatively, the MEMS humidity sensor is may send a signal to the processor in the night vision system. In turn, the processor may control the activation of an LED or activation of an alert on the micro-display of the system during normal startup built-in test procedures.

Figure 3:
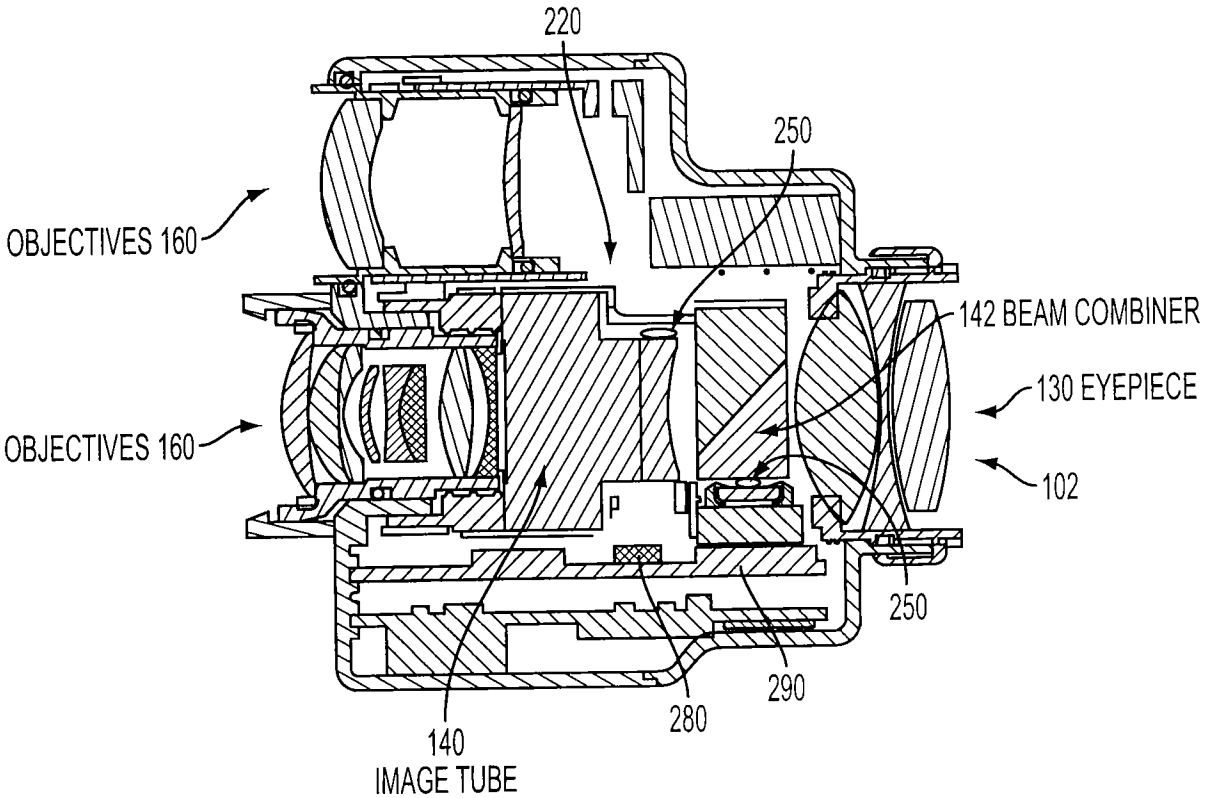
FIG. 3 is a cross-sectional illustration of another exemplary night vision system equipped with a humidity sensor located within the circuit boards of the present invention.

In yet another embodiment of the present invention, the MEMS humidity sensor may be located at other locations within the housing. For example, the MEMS humidity sensor may be located on a circuit card disposed inside the housing. As shown in FIG. 3, MEMS humidity sensor 280 is located on circuit card 290 within housing 220. The MEMS humidity sensor is sufficiently small and may, thus, be placed on each circuit card within the housing.

One LED 250 or multiple LEDs 250 may be coupled to one or more MEMS humidity sensors 280, either directly or indirectly by way of a microprocessor used in the night vision goggle system. Either way, each LED may be illuminated with a certain color, such as green, and when the MEMS humidity sensor detects moisture, the color of the LED may be changed to a different color, such as red, to indicate to the user that moisture is present within the housing of the night vision goggle system. In lieu of an LED, the micro-display of the goggle system may be used to provide an alert indication or indication of percent humidity, especially during system startup tests.

In an alternative embodiment, the LEDs may not illuminate until moisture is detected by the MEMS humidity sensor. In this embodiment, the LEDs 250 are not visible to the user until activated. Once the MEMS humidity sensor has detected moisture within the night vision goggle system, the LEDs illuminate indicating that the system needs servicing.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A goggle system comprising:

a housing including an image amplifier configured to amplify an image of an object of interest and circuitry configured to operate the image amplifier;

an eyepiece forming a back end of the housing for viewing the object of interest;

an eyecup forming a portion of the eyepiece at the back end of the housing, the eyecup for positioning an eye of a user for viewing the object of interest;

an optical field-of-view (FOV), formed through the eyepiece and the image amplifier, the FOV defined by a cone having an apex formed adjacent to the eyepiece and tapering outwardly toward the object of interest; and a desiccant disposed within the housing, and located outside the FOV;

wherein the desiccant is visible through the eyepiece, and not visible through the FOV.

2. The goggle system of claim 1 wherein when an eye of a user is placed at an exit pupil within the FOV, the desiccant is not visible through the eyepiece, and when the eye of the user is placed outside the FOV, the desiccant is visible through the eyepiece.

3. The goggle system of claim 1 wherein the FOV passes through an optical assembly extending between the eyepiece and the image amplifier, and the desiccant is visible through the same optical assembly.

4. The goggle system of claim 1, further comprising a plurality of desiccants disposed within the housing, and located outside a peripheral boundary of the FOV;

wherein the plurality of desiccants are visible through the eyepiece, and not visible through the FOV.

5. The goggle system of claim 1, wherein the desiccant includes an indicator substance that noticeably changes color as the desiccant becomes saturated with moisture.

6. The goggle system of claim 1, wherein a gap is included in a volume of space between an interior surface of the housing and an exterior surface of the image amplifier disposed in the housing, and the desiccant is disposed in the gap.

7. The goggle system of claim 6, wherein a line of sight is disposed from a point outside of the eyepiece and the desiccant disposed in the gap, and the FOV is free-of the desiccant disposed in the gap.

8. A night vision goggle system comprising:

a housing including an optical field-of-view (FOV) for viewing an object through an eyepiece of the goggle system, the FOV defined by an outward taper from the eyepiece toward the object of interest, the FOV including a peripheral boundary;

circuitry for operating the night vision goggle system disposed within the housing;

a desiccant disposed within the housing and located outside the FOV;

a humidity sensor disposed adjacent the circuitry of the night vision goggle system;

an indicating light emitting diode (LED) visible through the eyepiece; and the humidity sensor electrically coupled to the LED;

wherein the LED is activated when the humidity sensor senses that the desiccant becomes saturated with moisture.

9. The night vision goggle system of claim 8 wherein the LED is not visible when a viewer views the object in the FOV.

10. The night vision goggle system of claim 8 wherein the desiccant is a micro-electro-mechanical system (MEMS) humidity sensor.

11. The night vision goggle system of claim 8 wherein the humidity sensor is a desiccant.

12. An optical device for viewing a subject of interest comprising:

a housing containing optics for viewing the subject of interest, an image amplifier and circuitry for operating the image amplifier, an eyepiece forming a back end of the optics, an optical field-of-view (FOV), extending from the eyepiece, the FOV defined by a cone having an apex formed adjacent to the eyepiece and tapering outwardly, an eyecup forming a portion of the eyepiece at the back end of the housing, the eyecup for positioning an eye of a user for viewing the subject of interest;

a desiccant disposed within the housing, and located outside the FOV, wherein the desiccant is visible through the eyepiece, and not visible through the FOV, and when an eye of the user is placed within the FOV, the desiccant is not visible through the eyecup, and when the eye of the user is placed outside the FOV, the desiccant is visible through the eyecup.

13. The optical device of claim 12 wherein the FOV passes through the optics extending between the eyepiece and the subject of interest, and the desiccant is visible through the same optics.

14. The optical device of claim 12, wherein a gap is formed in a volume of space between an interior surface of the housing and an exterior surface of the optics disposed in the housing, and the desiccant is disposed in the gap.

15. The optical device of claim 14, wherein a line of sight is formed from a point outside of the eyepiece and the desiccant disposed in the gap, and the FOV is free-of the desiccant disposed in the gap.

16. The optical device of claim 15, wherein the desiccant includes an indicator substance that noticeably changes color as the desiccant becomes saturated with moisture.

17. The optical device of claim 15, wherein the desiccant includes a micro-electro-mechanical system (MEMS) humidity sensor.

* * * * *